US006602437B1

(12) United States Patent
Miller et al.

(10) Patent No.: US 6,602,437 B1
(45) Date of Patent: Aug. 5, 2003

(54) CHEMICALLY MODIFIED NONWOVEN ARTICLES AND METHOD FOR PRODUCING THE SAME

(75) Inventors: Brian C. Miller, Spartanburg, SC (US); Raymond C. Sturm, Spartanburg, SC (US)

(73) Assignee: Millikien & Company, Spartanburg, SC (US)

( * ) Notice: Subject to any disclaimer, the term of this patent is extended or adjusted under 35 U.S.C. 154(b) by 22 days.

(21) Appl. No.: 10/071,335

(22) Filed: Feb. 8, 2002

(51) Int. Cl.[7] ..... D06M 15/00
(52) U.S. Cl. ..... 252/8.62; 252/8.61; 252/8.84
(58) Field of Search ..... 252/8.61, 8.62, 252/8.84

(56) References Cited

U.S. PATENT DOCUMENTS 3,598,633 A * 8/1971 Rudman ..... 442/71
4,152,273 A * 5/1979 Weiland ..... 442/93
4,352,917 A * 10/1982 Tripp ..... 528/26
4,859,529 A * 8/1989 Raleigh et al. ..... 442/93
5,252,233 A * 10/1993 Czech ..... 252/8.63
5,759,685 A * 6/1998 Baris et al. ..... 428/364
5,899,785 A 5/1999 Groten et al. ..... 442/334
5,970,583 A 10/1999 Groten et al. ..... 19/296
6,200,915 B1 * 3/2001 Adams et al. ..... 442/157
6,354,620 B1 * 3/2002 Budden et al. ..... 280/728.1

* cited by examiner

*Primary Examiner*—Anthony J. Green
(74) *Attorney, Agent, or Firm*—Terry T. Moyer; Brenda D. Wentz

(57) ABSTRACT

A chemically modified nonwoven textile article and method for producing the same is provided that exhibits pilling resistance, soil release, strength, and abrasion resistance properties, thus rendering the article less prone to the formation of objectionable pill balls, staining, or loss of strength, thereby increasing wearer comfort and retaining the desired appearance of the article, and thereby extending the useful life of the article. A composition of matter for chemically modifying a nonwoven textile article to achieve pilling resistance, soil release, strength, and abrasion resistance is also provided.

14 Claims, No Drawings

CHEMICALLY MODIFIED NONWOVEN ARTICLES AND METHOD FOR PRODUCING THE SAME

BACKGROUND OF THE INVENTION

This invention relates to a process for chemically modifying nonwoven textile articles to impart pilling resistance and soil release properties to the article without compromising the strength and abrasion resistance of the article.

Nonwoven textile articles have historically possessed many attributes that led to their use for many items of commerce, such as air filters, furniture lining, and vehicle floorcovering, side panel and molded trunk linings. Among these attributes are lightweightness of the products, low cost and simplicity of the manufacturing process, and various other advantages. More recently, technological advances in the field of nonwovens, in areas such as abrasion resistance, fabric drape, fabric softness, and wash durability, have created new markets for nonwoven materials. For example, U.S. Pat. Nos. 5,899,785 and 5,970,583, both assigned to Freudenberg, describe a nonwoven lap of very fine continuous filament and the process for making such nonwoven lap using traditional nonwoven manufacturing techniques. The raw material for this process is a spun-bonded composite, or multi-component, fiber that is splittable along its length by mechanical or chemical action. As an example, after a nonwoven lap is formed, it may be subjected to high-pressure water jets which cause the composite fibers to partially separate along their length and become entangled with one another thereby imparting strength and microfiber-like softness to the final product. One such product manufactured and made available by Freudenberg according to these processes is known as Evolon®, and it is available in standard or point bonded variations. These manufacturing techniques allow for the efficient and inexpensive production of nonwoven fabrics having characteristics, such as strength, softness, and drapeability, equal to those of woven or knitted fabrics, which have end uses in products such as apparel, cleaning cloths, and artificial leather.

With the emergence of nonwovens into these new markets and increased consumer interest in such products, there has been a desire to produce fabrics with other characteristics, in addition to strength, similar to those of woven or knitted fabrics. Some of these characteristics include pilling resistance and soil release. Pilling typically results from fibers being pulled out of the fiber bundle and becoming entangled into a "ball" due to mechanical action, such as rubbing that, for example, fabrics encounter during normal use. These "pill balls" are a detriment to the appearance and comfort of textile articles. Reducing or eliminating the pilling propensity of textile articles would typically extend the useful life of the end-use product, such as a garment, by retaining its original appearance and comfort. Furthermore, soil release properties have obvious considerable importance for end-use products such as children's clothing, napery, and cleaning cloths since it is desirable to maintain the original appearance of these products for aesthetic reasons. Thus, it is an important attribute for nonwoven articles to possess pilling resistance and soil release characteristics without compromising strength and abrasion resistance of the articles for their emergence into these new markets.

SUMMARY OF THE INVENTION

In light of the foregoing discussion, it is one object of the current invention to achieve a nonwoven textile article which has been chemically modified to possess pilling resistance, soil release, and acceptable strength characteristics. Textile articles include fabrics, films, and combinations thereof. By pilling resistant, it is meant that the article achieves a minimum "B" rating after 18,000 cycles under a 9 kPa weight when tested for Martindale Pilling according to ASTM D4970 and using the Marks & Spencer Test Method P17 and rating the article on the Marks & Spencer Holoscope. Soil release is determined according to test method AATCC Method 130-2000 and is found to be acceptable for articles that achieve a minimum 3.0 rating after one wash cycle. The amount of strength that will generally be considered to be "acceptable" is the strength required for the treated article to function within its anticipated end product for a minimum number of use or wear cycles, which will generally also include intermittent cleaning cycles as well. The strength that is considered to be acceptable for a given article will therefore vary depending on the type of treated article, how it will be used in an end product, the type of end product, etc. By way of example, acceptable strength for an article intended for use as apparel is achieved with a minimum 2000 cycles when tested for Flex Abrasion according to ASTM D 3885. More specifically, by experience it has been determined that a certain nonwoven fabric comprised of spun-bonded continuous multi-component splittable fibers, wherein the fibers are 65% polyester and 35% nylon 6 or nylon 6,6, to be used in shirting should achieve a minimum of 2000 cycles when tested according to ASTM D 3885. Other standard methods for evaluating the pilling resistance, soil release, and abrasion resistance of fabrics may be used and are known and available to those skilled in the art.

A second object of the current invention is to achieve a nonwoven textile article, which has been chemically modified, that maintains its aesthetic appearance and comfort properties due to its resistance to pilling. The formation of "pill balls" leads to an unsightly appearance of the article. In addition, these "pill balls," when found in a garment, for example, generally result in a loss of garment comfort due to the abrasive nature of these protrusions against the skin. Therefore, reducing or eliminating the formation of "pill balls" allows for the extension of the useful life of textile articles, such as apparel, made from nonwoven fabric.

A further object of the current invention is to achieve a nonwoven textile article, which has been chemically modified, that maintains its aesthetic appearance due to its soil release characteristics. For example, garments or napery articles having food or soil stains are typically detracting to the appearance of those items. Thus, treating nonwoven textile articles with soil release chemicals would generally preserve the appearance of those articles and thereby extend the useful of those articles.

It is also an object of the current invention to achieve a method for chemically modifying nonwoven textile articles to impart pilling resistance and soil release properties to the articles while at the same time maintaining acceptable strength and abrasion resistance characteristics.

A further object of the current invention is to achieve a composition of matter for chemically modifying a nonwoven textile article to achieve pilling resistance, soil release, strength and abrasion resistance comprising a hydrophilic silicone, a soil release agent, an abrasion resistance agent, water, and optionally, a wetting agent and a defoaming agent.

Other objects, advantages, and features of the current invention will occur to those skilled in the art. Thus, while the invention will be described and disclosed in connection with certain preferred embodiments and procedures, such embodiments and procedures are not intended to limit the scope of the current invention. Rather, it is intended that all such alternative embodiments, procedures, and modifications are included within the scope and spirit of the disclosed invention and limited only by the appended claims and their equivalents.

DETAILED DESCRIPTION OF THE INVENTION

A nonwoven textile article is provided that has been chemically modified to achieve a useful change in certain of its properties. U.S. Pat. Nos. 5,899,785 and 5,970,583, both incorporated herein by reference, describe the composition and process for manufacturing the nonwoven lap that is the basis for the nonwoven textile article that is chemically modified by the current invention. Typically, the nonwoven article is a fabric comprised of spun-bonded continuous multi-component filament fiber that has been split, either partially or wholly, into its individual component fibers by exposure to mechanical or chemical means, such as high-pressure fluid jets. The fabric composition is generally 65% polyester fiber and 35% nylon 6 or nylon 6,6 fiber, although other fiber variations and combinations described by the above-mentioned patents are contemplated to be within the scope of this invention.

The process for chemically treating the nonwoven article, typically a fabric made from polyester and nylon composite fibers, involves the use of several chemicals combined in a mixture. The chemicals typically function as wetting agents, defoaming agents, soil release agents, pilling resistance agents, and abrasion resistance agents.

Generally, the wetting agents are ethoxylated long chain alcohols, such as Solpon® 839 available from Boehme Filatex, such that the long chains comprise at least 9 carbon atoms. Without being bound by theory, it is thought that the wetting agent improves adhesion, and possibly the chemical reaction that occurs, between the fabric and the other chemicals in the mixture. Because the untreated fabric typically tends to be inherently hydrophilic (approximately 100% wet pickup on weight of fabric in laboratory scale testing), the use of a wetting agent is optional. However, if a wetting agent is employed, concentrations typically range from between about 0.20 and about 0.30 weight percent on weight of the chemical mixture.

Depending on the specific mixture of chemicals applied to the fabric, a defoaming agent may be needed to reduce foam during the manufacturing process. For example, a mineral oil such as Tebefoam® VP1868 available from Boehme Filatex may be used. Other defoamers include silicone defoamers and de-aerating agents. The use of a defoamer is generally optional. However, if a defoamer is employed, typical concentrations may range from between about 0.05 and about 2 weight percent on weight of the chemical mixture.

Chemicals used to impart pilling resistance to the fabric are typically hydrophilic silicones (such as SilTouch® SRS available from Yorkshire PatChem). It is generally known to those skilled in the art that silicones usually hinder the pilling characteristics of fabrics. However, with the unique combination of chemicals employed in this invention, these silicones have actually been found to improve the pilling resistance of these fabrics. Typical concentrations for hydrophilic silicones range from between about 2 and about 8 weight percent on weight of the chemical mixture.

Soil release chemicals are typically chosen from acrylic compounds (such as Millitex® PD 75 available from Milliken Chemical), fluorocarbon compounds (such as Zonyl® 7910 available from Ciba Specialty Chemicals), or liquid polyesters (such as Millitex® PD 92 available from Milliken Chemical). The soil release chemicals have a tendency to form films around the fibers. Typical concentrations of acrylic soil release chemicals range from between about 2 and about 12 weight percent on weight of the chemical mixture. Concentrations of fluorocarbon soil release compounds generally range from between about 0.5 and about 6 weight percent on weight of the chemical mixture, and concentrations of liquid polyester soil release compounds generally range from between about 2 and about 6 weight percent on weight of the chemical mixture.

Chemicals used to impart abrasion resistance and strength to the fabric are generally polyethylenes (such as Aqualene N available from Moretex) or polyurethanes (such as Proteset FAI available from Synthron, Inc). Generally, polyethylenes with a higher melting point (usually referred to as high-density polyethylenes), such as greater than about 124 degrees Celsius, are preferred over low melting point polyethylenes (usually referred to as low-density polyethylenes), and they tend to form films around the fiber similar to the films formed by the soil release chemicals. Typical concentrations of polyethylenes range from between about 8 and about 16 weight percent on weight of the chemical mixture, while typical concentrations of polyurethanes range from between about 6 and about 18 weight percent on weight of the chemical mixture. Interestingly, the hydrophilic silicones, mentioned previously as pilling resistance chemicals, also tend to enhance the abrasion resistance of the fabric, while the polyethylenes mentioned above as abrasion resistance chemicals tend to enhance the pilling resistance of the fabric. It has been generally found that an intimate relationship exists between the use these two types of chemicals for generally enhancing both the abrasion resistance and the pilling resistance of the nonwoven textile article.

It should be noted that the concentrations of the chemicals used to treat the nonwoven textile articles can be varied within a relatively broad range, depending on the amount of pilling resistance and the amount of soil release desired for a particular end-use product, and is related to the inherent strength of the textile article to be processed. The inherent strength of the fiber which will ultimately be treated with the chemical mixture generally varies between different manufacturers of the fiber and between fiber types. As a result, these characteristics typically need to be examined in determining the concentration and amount of chemical to be used for a given treatment.

In one aspect of the invention, the process of the current invention requires no special equipment; standard textile dyeing and finishing equipment can be employed. By way of example, a nonwoven textile fabric may be treated either in a batch operation, wherein chemical contact is prolonged, or in a continuous operation, wherein chemical contact with the fabric is shorter. Generally, a predetermined amount of the desired chemical mixture is deposited onto the article, and the treated article is then dried, typically by exposing the article to a sufficient amount of heat for a predetermined amount of time. The application of the chemical mixture to the article may be accomplished by immersion coating, padding, spraying, foam coating, or by any other technique whereby one can apply a controlled amount of a liquid suspension to an article. Employing one or more of these application techniques may allow the chemical to be applied to a textile article in a uniform manner. As noted above, once the chemical has been applied to the article, the article is dried, generally by subjecting the article to heat. Heating can be accomplished by any technique typically used in manufacturing operations, such as dry heat from a tenter frame, microwave energy, infrared heating, steam, superheated steam, autoclaving, etc. or any combination thereof. The article may be dyed or undyed prior to chemical treatment. If undyed before treatment, the article may be dyed or printed after treatment. The article may also be subjected to various face-finishing processes and sanforization after chemical treatment. For example, U.S. Pat. Nos. 5,822,835, 4,918,795, and 4,837,902, incorporated herein by reference, disclose a face-finishing process wherein low pressure streams of gas are directed at high velocity to the surface of a fabric. The process ultimately softens and conditions the fabric due to vibration caused from airflow on the fabric.

The following examples illustrate various embodiments of the present invention but are not intended to restrict the scope thereof. In all examples, all percentages are by weight percent of the total chemical mixture (i.e., percent on weight of the chemical bath), unless otherwise noted.

All examples utilized nonwoven fabric comprised of spun-bonded continuous multi-component fibers which have been exposed to mechanical or chemical processes to cause the multi-component fibers to split, at least partially, along their length into individual polyester and nylon 6,6 fibers, according to processes described in the two Freudenberg patents earlier incorporated by reference. The fabric, known by its product name as Evolon®, was obtained from Firma Carl Freudenberg of Weinheim, Germany.

Pilling was determined by Martindale Pilling according to ASTM D4970 and the Marks & Spencer Test Method P17, wherein "A" indicates optimal pilling resistance and "E" indicates poor pilling resistance, when rating the fabric on the Marks & Spencer Holoscope. The Martindale Pilling exposed the fabric to a 9 kPa weight (595 grams) for 18,000 revolutions, or cycles. A Home Laundry Tumble Dry (HLTD) wash procedure was also incorporated as part of the Martindale Pilling test method. The HLTD involves washing the fabric in a standard residential washing machine at 105 degrees F for 12 minutes using 10 g of Tide® laundry detergent (available from Procter & Gamble) at the high water level setting. The fabric was then dried in a standard residential dryer for 45 minutes on the cotton sturdy setting. A 4-pound load of laundry comprised of the test fabric and non-test (or "dummy") fabric was used for each test.

Soil release was determined by AATCC Method 130-2000 using a scale from 1 to 5, wherein "5" indicates optimal soil release and "1" indicates poor soil release. Corn oil was applied to the fabric as the staining agent, and the fabric was rated for soil release after one wash (indicated as "0/1") and two washes (indicated as "0/2"). Further testing in some examples below includes staining the fabric again after the fourth wash and rating the fabric for soil release after the fifth wash (indicated as "4/5") and the sixth wash (indicated as "5/6").

Abrasion resistance and strength were determined by a variety of methods: (a) Flex Abrasion, according to ASTM D3885; (b) Stoll Flat Abrasion, according to ASTM D3886; (c) Elmendorf Tear, according to ASTM D1424, wherein the warp direction was estimated to be the direction the fabric entered and exited the machine during manufacturing (machine direction), and the fill direction was estimated to be perpendicular to the machine direction; (d) Trap Tear, according to ASTM D5587, wherein the test was performed on the warp, or machine direction of the fabric; and (e) Grab Tensile, according to ASTM D5034, wherein the test was performed on the warp, or machine direction of the fabric.

Note that "N/T" indicates that a sample was not tested for a given parameter.

EXAMPLE 1

The following example shows treatment of the nonwoven fabric with the chemical mixture of the current invention in a laboratory setting. The fabric utilized here was 100 g/m$^2$ point bonded Evolon®.

A one-liter solution of the desired chemical mixture was place in a beaker. The solution was comprised of 0.25% wetting agent (Synthropol® KB from Clariant), 4.0% hydrophilic silicone (Duosoft® OH from Boehme Filatex), 2.0% fluorocarbon (Zonyl® 7910 from Ciba Specialty Chemicals), 10.0% polyethylene (Atebin® 1062 from Boehme Filatex), and 83.75% water. The chemical mixture was then padded onto a 20"×20" piece of fabric by placing the fabric in the beaker and coating it with the mixture. The fabric was then removed from the beaker and run through a chemical padding machine to remove excess chemical. The fabric was then hung in an oven and dried at 360 degrees F for two minutes. The results are shown in Table 1 below.

TABLE 1

Comparison of Treated Nonwoven Fabric versus Untreated Nonwoven Fabric

| | Flex Abrasion (# Cycles to Failure) | | Martindale Pilling/ Marks & Spencer | Soil Release | |
|---|---|---|---|---|---|
| Sample | Warp | Fill | (18,000 Cycles, 9 Kpa) | 0/1 | 0/2 |
| Treated | | | | | |
| No HLTD | 11,129 | 4144 | A | 3.0 | 3.5 |
| 1 HLTD | N/T | | A | N/T | |
| 5 HLTD | N/T | | A | N/T | |
| Untreated | | | | | |
| No HLTD | 2522 | 2599 | A | 1.5 | 2.0 |
| 1 HLTD | N/T | | E | N/T | |
| 5 HLTD | N/T | | D | N/T | |

Several observations can be made regarding the data in Table 1. First, the chemically treated samples exhibit greater abrasion resistance than the untreated samples in both the warp estimated and fill estimated directions according to the Flex Abrasion test method. The warp direction withstands a higher amount of abrasion than the fill direction, which is most likely explicable by the fact that the warp direction is estimated as the machine direction of the fabric during the manufacturing process, which typically tends to be inherently stronger than the fill direction. Martindale Pilling shows pilling resistance is greatly enhanced after laundering for the treated fabric sample. It also indicates that the fabric is strong enough to withstand at least the minimum number of cycles typical for end-use products such as apparel, bedding, napery, and upholstery. This minimum number of cycles is typically about 2000 cycles for these end-uses. Additionally, the soil release property of the fabric is increased for both the 0/1 and 0/2 tests after chemical treatment. These factors indicate the effectiveness of the chemical treatment for achieving pilling resistance and soil release on the nonwoven textile article without compromising (and actually improving) abrasion resistance in both the warp and fill estimated directions.

EXAMPLE 2

Example 1 was repeated, except that the concentration of Zonyl® 7910, a soil release agent according to the present invention, was increased from 2.0 weight percent to 4.0 weight percent on weight of the chemical mixture. The soil release results are shown in Table 2 below.

TABLE 2

Comparison of Soil Release Concentration on Treated Nonwoven Fabric

| Sample | Soil Release Results 0/1 | 0/2 | 4/5 | 5/6 |
|---|---|---|---|---|
| 2.0% Zonyl ® 7910 | 3.0 | 3.5 | 3.0 | 3.5 |
| 4.0% Zonyl ® 7910 | 3.5 | 4.0 | 3.0 | 3.5 |

Table 2 shows that increasing the amount of soil release chemical from 2.0 to 4.0 weight percent on weight of the chemical mixture, while maintaining unchanged concentrations of the other chemicals, increases the soil release properties of the treated fabric after 1 wash and after 2 washes. These results indicate the effectiveness of the soil release chemicals at optimal concentration for the present invention.

EXAMPLE 3

The following example shows treatment of the fabric with the chemical mixture of the current invention in a manufacturing or production setting. The fabric utilized here included both 100 g/m$^2$ and 120 g/m$^2$ standard and point bonded Evolon® fabric. Some fabric samples were undyed, while others were dyed using standard dyeing techniques (both jet-dye and continuous dyeing processes) and dye formulations known to those skilled in the art.

The chemical mixture was prepared using 0.25% wetting agent (Solpon® 839 from Boehme Filatex), 10% polyethylene (Atebin® 1062 from Boehme Filatex), 6% hydrophilic silicone (Duosoft® OH from Boehme Filatex), 4% fluorocarbon (Zonyl® 7910 from Ciba Specialty Chemicals), and 79.75% water. There were ten 100-yard fabric samples treated with the chemical mixture (Samples 3–7 and 10–14) and four 100-yard control fabric samples treated only with water (Samples 1–2 and 8–9). The samples included:

| Sample Number | Sample Description |
|---|---|
| 1 | Standard Greige, 100 g/m$^2$ (Control A) |
| 2 | Point Bonded Greige, 100 g/m$^2$ (Control B) |
| 3 | Standard Prepared For Print, 100 g/m$^2$ |
| 4 | Point Bonded Prepared For Print, 100 g/m$^2$ |
| 5 | Point Bonded Continuous Dyed White, 100 g/m$^2$ |
| 6 | Point Bonded Continuous Dyed Navy, 100 g/m$^2$ |
| 7 | Point Bonded Jet-Dyed Burgundy, 100 g/m$^2$ |
| 8 | Standard Greige, 120 g/m$^2$ (Control C) |
| 9 | Point Bonded Greige, 120 g/m$^2$ Control D) |
| 10 | Standard Prepared For Print, 120 g/m$^2$ |
| 11 | Standard Jet-Dyed Navy, 120 g/m$^2$ |
| 12 | Point Bonded Jet-Dyed Green, 120 g/m$^2$ |
| 13 | Point Bonded Jet-Dyed Tan, 120 g/m$^2$ |
| 14 | PS33 (point bonded in herringbone pattern) Continuous Dyed White, 120 g/m$^2$ |

The chemical mixture was padded on the fabric by dipping the fabric in the dip pad of a pin tenter range. The pad nip pressure was 55 psi with a wet pick up of 140%. The overfeed to chain speed was 2%, and all circulating fans were set on high. The vacuum slot was turned off. The fabric was then dried in the tenter by running the fabric at 40 yards per minute through the heat zones of the tenter which averaged 366 degrees F. The exhaust dampers were set at 50%, and the cooling cans were 80 degrees F. The winder oscillator was off.

After drying, the fabric was exposed to a face-finishing process (as described in U.S. Pat. Nos. 5,822,835, 4,918,795, and 4,837,902), wherein two zones of high velocity gaseous fluid were directed to the surface of the fabric in opposite directions at 20 psi and at 1.0 tension setting on the entry and exit rolls. Following this treatment, the fabric was sanforized. The fabric was then inspected and tested for abrasion resistance and strength. The results are shown in Table 3 below.

TABLE 3

Abrasion Resistance and Strength of Treated Nonwoven Fabric versus Untreated Nonwoven Fabric

| Sample | Elmendorf Tear (Pounds) Warp | Trap Tear (Pounds) Warp | Grab Tensile (Pounds) Warp | Stoll Flat (# Cycles to Failure) | Flex Abrasion (# Cycles to Failure) |
|---|---|---|---|---|---|
| 1 (Control A) | 1.17 | 6.51 | 65.8 | 518.0 | 602 |
| 2 (Control B) | 0.56 | 5.04 | 67.5 | 499.3 | 490 |
| Control Average | 0.87 | 5.78 | 66.7 | 508.7 | 546 |
| 3 | 2.59 | 10.25 | 75.6 | 483.0 | 17,149 |
| 4 | 2.14 | 9.60 | 82.8 | 693.0 | 18,818 |
| 5 | 2.05 | 8.27 | 82.6 | 536.0 | 18,632 |
| 6 | 2.05 | 8.97 | 82.5 | 634.0 | 18,674 |
| 7 | 2.22 | 8.70 | 75.4 | N/T | N/T |
| Sample 3–7 Average | 2.21 | 9.16 | 79.8 | 586.5 | 18,318 |
| 8 (Control C) | 1.07 | 6.57 | 80.4 | 602.0 | 475 |
| 9 (Control D) | 0.75 | 4.85 | 85.3 | 758.7 | 675 |
| Control Average | 0.91 | 5.71 | 82.9 | 680.4 | 575 |
| 10 | 3.01 | 10.09 | 84.2 | 693.0 | 19,673 |
| 11 | 3.15 | 11.49 | 85.4 | 1033.0 | N/T |
| 12 | 2.95 | 14.98 | 96.7 | 1299.0 | 14,797 |
| 13 | 2.87 | 12.43 | 93.2 | N/T | N/T |

TABLE 3-continued

| Sample | Abrasion Resistance and Strength of Treated Nonwoven Fabric versus Untreated Nonwoven Fabric | | | | |
|---|---|---|---|---|---|
| | Elmendorf Tear (Pounds) Warp | Trap Tear (Pounds) Warp | Grab Tensile (Pounds) Warp | Stoll Flat (# Cycles to Failure) | Flex Abrasion (# Cycles to Failure) |
| 14 | 2.33 | 9.97 | 105.6 | 1104.0 | 19,708 |
| Sample 10–14 Average | 2.86 | 11.79 | 93.0 | 1032.3 | 18,059 |

Several observations can be made regarding the results shown in Table 3. All of the treated samples, both the 100 g/m$^2$ and 120 g/m$^2$ fabrics, exhibit improved abrasion resistance after treatment with the chemical mixture of the present invention. The heavier weight 120 g/m$^2$ samples, both treated and untreated, generally exhibited higher strength and abrasion resistance characteristics. Exposure of the fabric to a wide variety of different abrasion and strength tests as shown in this example confirms the usefulness and applicability of this fabric treatment for a large array of end-use applications as previously discussed.

The above description and examples show that the present invention provides a novel method for imparting pilling resistance and soil release properties to nonwoven textile articles without compromising the strength and abrasion resistance characteristics of the articles. Accordingly, the invention has many applicable uses for incorporation into articles of apparel, bedding, residential upholstery, commercial upholstery, automotive upholstery, napery, residential and commercial cleaning cloths, and any other article wherein it is desirable to manufacture a pilling resistant product with soil release properties that retains its required strength and abrasion resistance characteristics for its intended end use.

The above description and examples also provide a novel composition of matter for imparting pilling resistance, soil release, strength, and abrasion resistance properties to nonwoven textile articles. The composition of matter comprises a hydrophilic silicone, a soil release agent, an abrasion resistance agent, water, and optionally a wetting agent and a defoaming agent. The concentration of the hydrophilic silicone is between about 2 and about 8 weight percent on weight of the composition of matter. The soil release agents are selected from the group consisting of acrylics, fluorocarbons, liquid polyesters, and combinations thereof. The concentration of acrylic is between about 2 and about 12 weight percent on weight of the composition of matter. The concentration of fluorocarbon is between about 0.5 and about 6 weight percent on weight of the composition of matter. The concentration of liquid polyester is between about 2 and about 6 weight percent on weight of the composition of matter. The abrasion resistance chemicals are selected from the group consisting of polyethylenes, polyurethanes, and combinations thereof. The concentration of polyethylene is between about 8 and about 16 weight percent on weight of the composition of matter. Generally, polyethylenes with a higher melting point (usually referred to as high-density polyethylenes), such as greater than about 124 degrees Celsius, are preferred over low melting point polyethylenes (usually referred to as low-density polyethylenes). The concentration of polyurethane is between about 6 and about 18 weight percent on weight of the composition of matter. A wetting agent, such as an ethoxylated long chain alcohol wherein the chain is at least 9 carbon atoms long, may be included as a component of this composition of matter in concentrations of between about 0.2 and about 0.3 weight percent on weight of the composition of matter. A defoaming agent, such as mineral oil, silicone defoamers, and de-aerating agents, may be included as a component of this composition of matter in concentrations of between about 0.05 and about 2 weight percent on weight of the composition of matter.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

What we claim is:

1. A composition of matter for chemically modifying a nonwoven textile article to achieve pilling resistance, soil release, strength, and abrasion resistance comprising: a hydrophilic silicone, a soil release agent, wherein the soil release agent is selected from the group consisting of acrylic, fluorocarbon, liquid polyester, and combinations thereof, an abrasion resistance agent, wherein the abrasion resistance agent is selected from the group consisting of polyethylene, polyurethane, and combinations thereof, and water.

2. The composition of matter of claim 1, wherein the concentration of hydrophilic silicone is between about two and about eight weight percent on weight of the composition of matter.

3. The composition of matter of claim 1, wherein the soil release agent is acrylic and the concentration of said acrylic is between about 2 and about 12 weight percent on weight of the composition of matter.

4. The composition of matter of claim 1, wherein the soil release agent is fluorocarbon and the concentration of said fluorocarbon is between about 0.5 and about 6 weight percent on weight of the composition of matter.

5. The composition of matter of claim 1, wherein the soil release agent is liquid polyester and the concentration of said liquid polyester is between about 2 and about 6 weight percent on weight of the composition of matter.

6. The composition of matter of claim 1, wherein the abrasion resistance agent is polyethylene and the concentration of said polyethylene is between about 8 and about 16 weight percent on weight of the composition of matter.

7. The composition of matter of claim 6, wherein the abrasion resistance agent is polyethylene and said polyethylene is a high-density polyethylene, wherein said high-density polyethylene has a melting point of greater than about 124 degrees Celsius.

8. The composition of matter of claim 1, wherein the abrasion resistance agent is polyurethane and the concentration of said polyurethane is between about 6 and about 18 weight percent on weight of the composition of matter.

9. The composition of matter of claim 1, wherein the composition of matter further includes a wetting agent.

10. The composition of matter of claim 9, wherein the composition of matter further includes a wetting agent and said wetting agent is an ethoxylated long chain alcohol.

11. The composition of matter of claim 10, wherein the wetting agent is an ethoxylated long chain alcohol and the concentration of said ethoxylated long chain alcohol is between about 0.20 and about 0.30 weight percent on weight of the composition of matter.

12. The composition of matter of claim 1, wherein the composition of matter further includes a defoaming agent.

13. The composition of matter of claim 12, wherein the composition of matter further includes a defoaming agent and said defoaming agent is selected from the group consisting of mineral oil, silicone, and de-aerating agents.

14. The composition of matter of claim 13, wherein the defoaming agent is mineral oil and the concentration of said mineral oil is between about 0.05 and about 2 weight percent on weight of the composition of matter.

* * * * *